US005533871A

United States Patent [19]

Takenaka et al.

[11] Patent Number: 5,533,871

[45] Date of Patent: Jul. 9, 1996

[54] SINGLE-HEADED-PISTON-TYPE SWASH-PLATE COMPRESSOR HAVING PULSATION DAMPING SYSTEM

[75] Inventors: Kenji Takenaka; Hiroaki Kayukawa; Kazushige Murao; Osamu Hiramatsu, all of Kariya, Japan

[73] Assignee: Kabushiki Kaisha Toyoda Jidoshokki Seisakusho, Aichi, Japan

[21] Appl. No.: 364,717

[22] Filed: Dec. 27, 1994

[30] Foreign Application Priority Data

Dec. 27, 1993 [JP] Japan ..... 5-330394

[51] Int. Cl.[6] ..... F04B 25/04

[52] U.S. Cl. ..... 417/269; 417/540

[58] Field of Search ..... 417/269, 540

[56] References Cited

U.S. PATENT DOCUMENTS 4,610,604 9/1986 Iwamori ..... 417/269

5,364,232 11/1994 Kimura et al. ..... 417/269 X

FOREIGN PATENT DOCUMENTS 50-44313 5/1975 Japan .

*Primary Examiner*—Richard E. Gluck

*Attorney, Agent, or Firm*—Burgess, Ryan and Wayne

[57] ABSTRACT

A single-headed piston type swash-plate compressor has a cylinder block having cylinder bores in which a plurality of pistons are slidably received. A first housing is attached to a first end of the block to form a crank chamber therebetween, and a second housing is attached to a second end thereof to form an annular suction chamber and a central discharge chamber therebetween. The chambers are partitioned by an annular wall portion projected from an inner wall of the second housing such that the suction chamber surrounds the discharge chamber. A drive shaft rotatably is extended through the crank chamber, and a conversion mechanism is provided on the shaft for converting a rotating movement of the shaft into a reciprocating movement of each piston in the corresponding bore such that a suction stroke and a discharge stroke are alternately executed therein. During the suction stroke, a fluid is introduced from the suction chamber into the bore, and during the compression stroke, the introduced fluid is compressed and discharged from the bore into the discharge chamber. The cylinder block has a portion extended radially and outwardly from a side thereof, and the portion has a damping chamber formed therein. The discharge chamber has an elongated portion extended radially and outwardly therefrom, the elongated portion being in communication with the damping chamber through a small passage formed in the extended portion of the block.

4 Claims, 2 Drawing Sheets

SINGLE-HEADED-PISTON-TYPE SWASH-PLATE COMPRESSOR HAVING PULSATION DAMPING SYSTEM

BACKGROUND OF THE INVENTION

1. Field of the Invention

The present invention relates to a single-headed-piston-type swash-plate compressor used in, for example, an air-conditioning system incorporated in a vehicle such as an automobile, and more particularly, to a single-headed piston type swash-plate compressor having a damping system for suppressing pulsations in the discharge pressure of a compressed refrigerant gas.

2. Description of the Related Art

Generally, a single-headed-piston-type swash-plate compressor comprises: a cylinder block having a plurality of cylinder bores radially formed therein and arranged with respect to the central axis thereof; a plurality of pistons slidably received in the cylinder bores, respectively; a front housing securely fixed to a front end wall of the cylinder block to form a crank chamber therebetween; a drive shaft axially extended through the crank chamber such that the ends thereof are rotatably supported by the front housing and the cylinder block, respectively; a conversion mechanism provided on the drive shaft within the crank chamber for converting a rotating movement of the drive shaft into a reciprocating movement of the pistons; a rear housing or cylinder head housing securely fixed to a rear end wall of the cylinder block to form a suction chamber and a discharge chamber therebetween; and a valve plate assembly provided between the cylinder block and the cylinder head housing.

The valve plate assembly in particular comprises: a disc-like member having several sets of a suction port and a discharge port opened to the suction chamber and the discharge chamber, respectively, each set being able to communicate with the corresponding one of the cylinder bores in the cylinder block; an inner valve sheet attached to the inner side surface of the disc-like member and having suction reed valve elements formed integrally therein, each of which is arranged so as to open and close the corresponding suction port in the disc-like member; and an outer valve sheet attached to the outer side surface of the disc-like member and having discharge reed valve elements formed integrally therein, each of which is arranged so as to open and close the corresponding discharge port in the disc-like member.

When the compressor is incorporated in an air-conditioning system for a vehicle such as an automobile, the drive shaft is rotationally driven by the prime mover or engine of the automobile, and the suction chamber and the discharge chamber are in communication with an evaporator and a condenser of the air-conditioning system through an inlet port and an outlet port formed in the cylinder head housing, to allow a refrigerant gas to circulate in the air-conditioning system. The rotational movement of the drive shaft causes the pistons to be reciprocated in the cylinder bores due to the conversion mechanism provided on the drive shaft within the crank chamber. When each piston is reciprocated in the corresponding cylinder bore, and thus a suction stroke and a compression stroke are repeatedly executed therein, a suction stroke is executed in one of the aligned cylinder bores. During the suction stroke, the suction reed valve element is opened and the discharge reed valve element is closed, whereby the refrigerant gas is delivered from the suction chamber to the cylinder bore through the suction port. During the compression stroke, the suction reed valve element concerned is closed and the discharge reed valve element concerned is opened, whereby the delivered refrigerant gas is compressed and discharged from the cylinder bore into the discharge chamber, through the discharge reed valve element.

The operation of the compressor as described above, produces pulsations in the discharge pressure of the compressed refrigerant gas, and the pulsations cause noise and vibration. To prevent the noise and vibration, the compressor can be provided with a damping chamber for suppressing the pulsations in discharge pressure of a compressed refrigerant gas, as disclosed in, for example, Unexamined Japanese Utility Model Publication No. 50(1975)-44313. In particular, the damping chamber is incorporated in the cylinder head housing such that the damping chamber is in communication with the discharge chamber through small passages provided therebetween, and has an outlet port formed in a wall portion defining the damping chamber. Using this arrangement, the pulsations can be suppressed by passing the compressed and discharged refrigerant gas from the discharge chamber into the damping chamber through the small passages. Nevertheless, the incorporation of the damping chamber in the cylinder head housing results in an increase in the axial length thereof. An increase in the axial length of the compressor should be avoided because there is a strong demand for making the axial length of the compressor as small as possible, especially in the automobile field.

In a double-headed piston type swash-plate compressor, the damping chamber is frequently provided on a side wall of the compressor so as to avoid an increase in the axial length thereof, and the damping chamber is in communication with the discharge chamber through a passage formed in the cylinder block and arranged between the adjacent cylinder bores. However, his concept cannot be applied to the single-headed-piston-type swash-plate compressor because the thickness of the portion in the cylinder block between the adjacent cylinder bores is relatively thin in comparison with the corresponding portion of the cylinder block of the double-headed-piston-type swash-plate compressor.

SUMMARY OF THE INVENTION

Accordingly, an object of the present invention is to provide a single-headed-piston-type swash-plate compressor having a damping system for suppressing pulsations in the discharge pressure of a compressed refrigerant gas, wherein such a damping system is incorporated in the compressor without resulting in an increase in the axial length thereof.

In accordance with the present invention, there is provided a single-headed-piston-type swash-plate compressor comprising: a cylinder block having cylinder bores formed therein; a plurality of pistons slidably received in the cylinder bores of the cylinder block, respectively; a first housing associated with an end side of the cylinder block so as to form a crank chamber therebetween; a second housing associated with the other end side of the cylinder block so as to form an annular suction chamber and a central discharge chamber therebetween, the suction and discharge chambers being partitioned by an annular wall portion projected from an inner wall of the second housing such that the annular suction chamber surrounds the central discharge chamber; a drive shaft rotatably provided in and extended through the crank chamber; and a conversion mechanism provided on the drive shaft within the crank chamber for converting a rotating movement of the drive shaft means into a reciprocating movement of each piston in the corresponding cylinder bore such that a suction stroke and a discharge stroke are alternately executed therein, a fluid being introduced from the suction chamber into the cylinder bore during the suction stroke, and during the compression stroke, the introduced fluid being compressed and discharged from the cylinder bore into the discharge chamber, wherein the cylinder block is provided with a portion extended radially and outwardly from a side thereof, the portion having a damping chamber formed therein, and wherein the discharge chamber has an elongated portion extended radially and outwardly therefrom, the elongated portion being in communication with the damping chamber through a small passage formed in the extended portion of the cylinder block.

Preferably, the single-headed piston type swash-plate compressor further comprises a valve plate assembly provided between said the other end side of the cylinder block and the cylinder block, and the above-mentioned small passage is formed in both the extended portion of the cylinder block and the valve plate assembly. Also, preferably, the elongated portion of the discharge chamber is disposed along a radially-extended zone between the end openings of the two adjacent cylinder bores formed in the cylinder block. Further, preferably, the extended portion of the cylinder block has a recess formed therein and closed by a lid member to define the damping chamber therebetween.

BRIEF DESCRIPTION OF THE DRAWINGS

The other objects and advantages of the present invention will be better understood from the following description, with reference to the accompanying drawings, in which.

DESCRIPTION OF THE PREFERRED EMBODIMENTS

Figure 1:
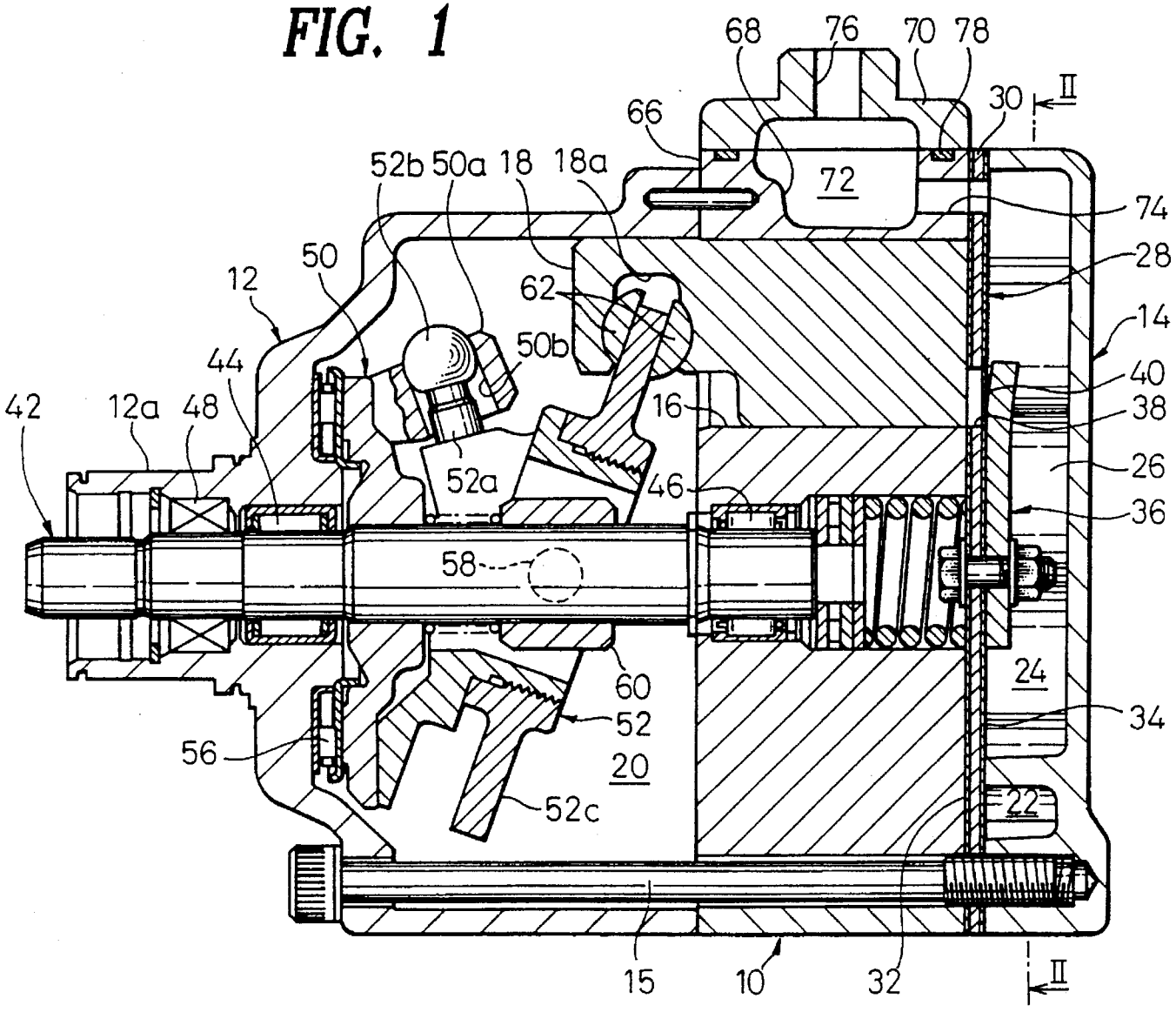
FIG. 1 is a longitudinal sectional view taken along the line I—I of FIG. 2, and showing a single-headed-piston type swash-plate compressor according to the present invention.

FIG. 1 shows a single-headed-piston type swash-plate compressor in which the present invention is embodied, and which may be used in an air-conditioning system (not shown) for a vehicle such as an automobile. The compressor comprises a cylinder block 10, front and rear housings 12 and 14 securely and hermetically joined to the cylinder block 10 at front and rear end walls thereof, respectively, by seven bolts 15 extended therethrough. The cylinder block 10 has a plurality of cylinder bores, for example, seven cylinder bores 16 formed radially and circumferentially therein and spaced from each other at regular intervals, and each of the cylinder bores slidably receives a piston 18. The front housing 12 has a crank chamber 20 defined therewithin, and the rear housing or cylinder head housing 14 has an annular suction chamber 22 and a central discharge chamber 24 defined therewithin and partitioned by an annular wall portion 26 integrally projected from an inner wall of the cylinder head housing 14.

A valve plate assembly 28 is disposed between the rear end wall of the cylinder block 10 and the cylinder head housing 14, and includes a disc-like plate member 30, a suction reed valve sheet 32 applied to an inner side surface of the disc-like plate member, a discharge reed valve sheet 34 applied to an outer side surface of the disc-like plate member 30, and a retainer member 36 securely attached to an outer side surface of the discharge reed valve sheet 34. The disc-like member 30 may be made of a suitable metal material such as steel, and has seven sets of suction and discharge ports formed radially and circumferentially therein, and spaced from each other at regular intervals, so that each set of the suction and the discharge ports and is encompassed within an end opening area of the corresponding one of the cylinder bores 16. Of course, the suction ports of the disc-like plate member 30 are arranged within the suction chamber 22, and the discharge ports thereof and the retainer member 36 are arranged within the discharge chamber 24. Note, in FIG. 1, the suction ports are not visible, but one of the discharge ports is visible and is indicated by reference numeral 38.

The suction reed valve sheet 32 and the discharge reed valve sheet 34 may be made of spring steel, phosphor bronze, or the like. The suction reed valve sheet 32 has seven suction reed valve elements (not visible) formed integrally therewith and arranged radially and circumferentially to be in register with the suction ports of the disc-like member 30, respectively, whereby each of the suction reed valve elements can be moved so as to open and close the corresponding suction port, due to a resilient property thereof. Also, the suction reed valve sheet 32 has seven openings formed therein and arranged radially and circumferentially to be in register with the discharge ports of the disc-like member 30. On the other hand, the discharge reed valve sheet 34 has seven discharge reed valve elements 40 (in FIG. 1, only one thereof is visible) formed integrally therewith and arranged radially and circumferentially to be in register with the discharge ports 38, respectively, whereby each of the discharge reed valve elements 40 can be moved so as to open and close the corresponding discharge port 38, due to a resilient property thereof. Also, the discharge reed valve sheet 32 has seven openings formed therein and arranged radially and circumferentially to be in register with the suction ports of the disc-like member 30.

The retainer member 36 has seven retainer elements radially extended therefrom and arranged radially and circumferentially to be in alignment with the discharge reed valve elements 40, respectively. As shown in FIG. 1, each of the retainer elements provides a sloped bearing surface for the corresponding one of the discharge reed valve elements 40, so that each discharge reed valve element 40 can be opened only to a given angle defined by the sloped bearing surface.

A drive shaft 42 extends within the front housing 12 so that the rotational axis thereof matches the longitudinal axis of the front housing 12, and a front end of the drive shaft 42 is projected outside from an opening formed in a neck portion 12*a* of the front housing 12 and is operatively connected to a prime mover of the vehicle for rotation of the drive shaft 42. The drive shaft 42 is rotatably supported by a first radial bearing 44 provided in the opening of the neck portion 12*a* and by a second radial bearing 46 provided in a central bore formed in the cylinder block 10. A suitable shaft seal unit 48 is provided in the opening of the neck portion 12*a* adjacent to the first radial bearing 44, to thereby seal the crank chamber 20 to the outside.

A conversion mechanism is provided on the drive shaft 42 within the crank chamber 20 for converting the rotating movement of the drive shaft 42 into a reciprocating movement of the pistons 18. In this embodiment, the conversion mechanism comprises, as a main element thereof, a drive plate member 50, and a swingable annular swash plate member 52 associated therewith. The drive plate member 50 is securely mounted on the drive shaft 42 so as to be rotated together therewith, and a thrust bearing 56 is disposed between the drive plate member 50 and an inner end wall portion of the front housing 12. The swash plate member 52 is swingably supported by a pair of pin elements 58 projected diametrically from a sleeve member 60 slidably mounted on the drive shaft 42. Namely, the swash plate member 52 has a central opening through which the drive shaft 42 is extended, and is swingable around a lateral axis defined by the pair of pin elements 58. Note, in FIG. 1, only one pin element 58 is illustrated by a broken line. The drive plate member 50 is provided with an extension 50*a* having a hole 50*b* formed therein, and the swash plate member 52 is provided with a pin element 52*a* extended therefrom and received in the hole 50*b*, and the pin element 52*a* has a sphere element 52*a* securely attached to an free end of the pin element 52*a* and slidably engaged in the hole 50*b*, whereby the swash plate member 52 can be rotated together with the drive plate member 56.

The swash plate member 52 has a peripheral annular portion 52*c*, which is engaged with the pistons 18 to cause these pistons to be reciprocated in the cylinder bores 16, respectively, by rotation of the swash plate member 52. In particular, each of the pistons 18 has a slot 18*a* formed at an inner end thereof to receive the peripheral annular portion 52*c* of the swash plate member 52, and two semi-spherical shoe elements 62, 62 are slidably provided between the opposed sides of the peripheral annular portion 52*c* and the opposite side walls of the slot 18*a*, respectively. The opposite side walls of the slot 18*a* have a semi-spherical recess formed therein, and each shoe elements 62, 62 is slidably received in the corresponding recess. Thus, each of the pistons 18 can be reciprocated in the corresponding cylinder bore 16.

Figure 2:
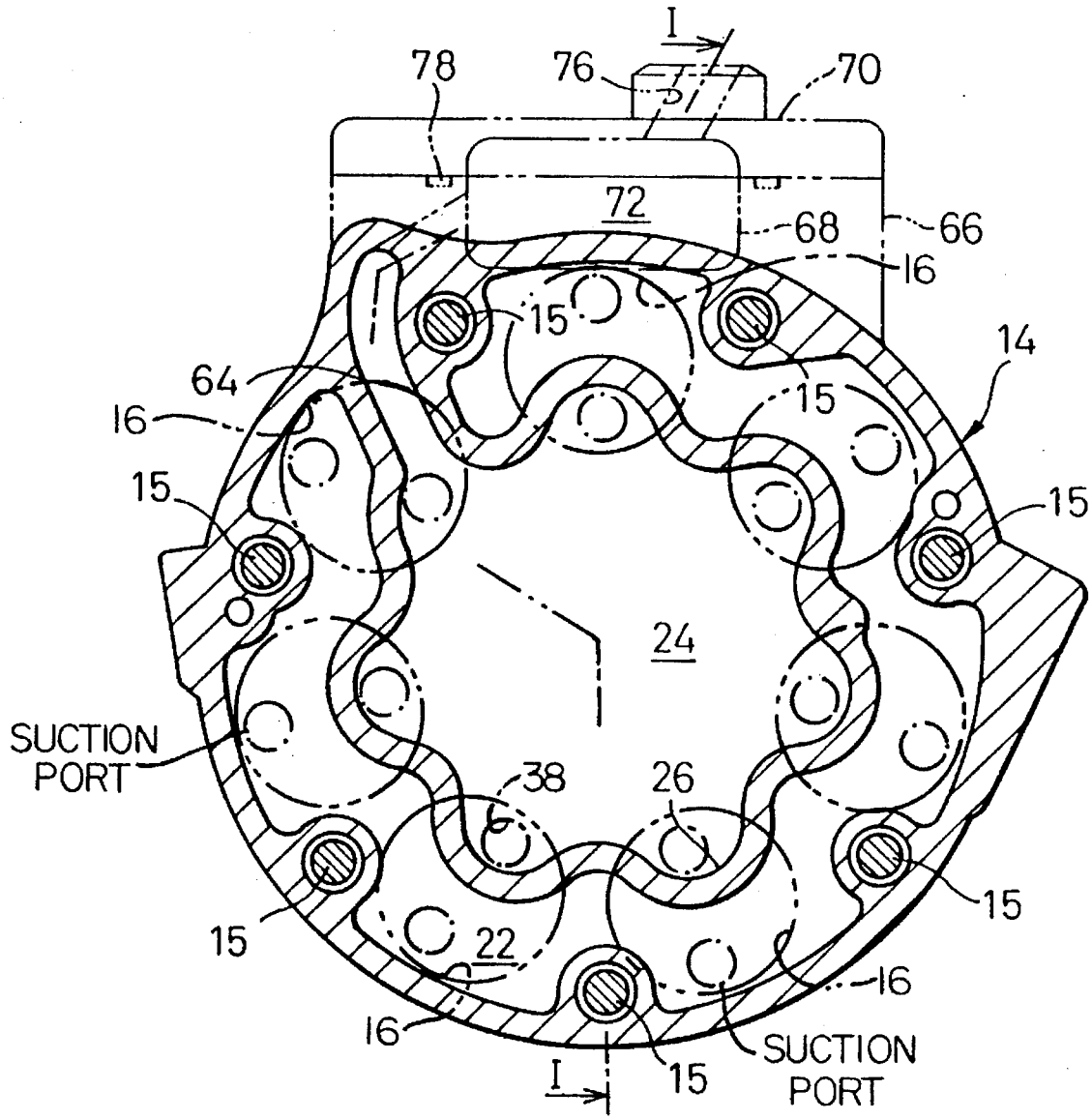
FIG. 2 is a cross sectional view taken along the line II—II of FIG. 1, but eliminating the cylinder block, the pistons., and the valve plate assembly of the compressor therefrom, for simplicity.

According to the present invention, as shown in FIG. 2, the discharge chamber 24 has an elongated portion 64 extended radially and outwardly therefrom. Namely, the annular wall portion 26 is partially integrated with a peripheral wall of the cylinder head housing 14 so as to define the elongated portion 64. On the other hand, the cylinder block 10 has a portion 66 extended radially and outwardly from a side thereof, and the extended portion 66 has a recess 68 formed therein and closed by a lid member 70 to define a damping chamber 72 therebetween. The damping chamber 72 is in communication with the elongated portion 64 forming a part of the discharge chamber 24, through a small passage 74 formed in both the valve plate assembly 28 and the extended portion 66 and opened at an outer end of the elongated portion 64. Note, of course, the elongated portion 64 of the discharge chamber 24 is extended and disposed along an radially-extended zone between the end openings of the two adjacent cylinder bores 16, 16. The lid member 70 has an outlet port 76 formed therein, the damping chamber 72 is in communication with a condenser of an air-conditioning system through the outlet port 76, and the suction chamber 24 is in communication with an evaporator of the air-conditioning system through an inlet port (not visible) formed in the cylinder housing 14. The lid member 70 may be securely fixed on the extended portion 66 by set screws, and an O-ring seal 78 is provided between the lid member 70 and the extended portion 66.

In operation, during the rotation of the drive shaft 42, the pistons 18 are reciprocated in the cylinder bores 16, respectively, so that a suction stroke and a compression stroke are alternately executed in each of the cylinder bores 16. During the suction stroke, the suction reed valve is opened, so that the refrigerant gas is introduced from the suction chamber 22 into the bore 16 through the suction port. During the compression stroke, the suction reed valve is closed, so that the introduced refrigerant gas is compressed in the bore 16. When the pressure of the compressed refrigerant gas is higher than that in the discharge chamber 24, the discharge reed valve is opened, so that the compressed refrigerant gas is discharged from the bore 16 into the discharge chamber 24 through the discharge port 38.

Pulsations are produced in the discharge pressure in the discharge chamber 24 due to the reciprocating motion of the pistons 18, and the frequency of the pulsations depends upon the number of cylinder bores 16 and the rotational speed of the compressor. Nevertheless, the pulsations can be suppressed by passing the compressed and discharged refrigerant gas from the discharge chamber 24 into the damping chamber 72 through the small passage 74.

With the arrangement of the damping system as mentioned above, the axial length of the compressor is not increased because the damping chamber 72 is provided in the side wall of the cylinder block 10, and communication between the discharge chamber 24 and the damping chamber 72 is made possible by extending, radially and outwardly, the elongated portion 64 from the discharge chamber 24.

Finally, it will be understood by those skilled in the art that the foregoing description is of a preferred embodiment of the disclosed compressor, and that various changes and modifications may be made to the present invention without departing from the spirit and scope thereof.

We claim:

1. A single-headed-piston-type swash-plate compressor comprising:

a cylinder block having cylinder bores formed therein;

a plurality of pistons slidably received in the cylinder bores of said cylinder block, respectively;

a first housing associated with an end side of said cylinder block so as to form a crank chamber therebetween;

a second housing associated with the other end side of said cylinder block so as to form an annular suction chamber and a central discharge chamber therebetween, said suction and discharge chambers being partitioned by an annular wall portion projected from an inner wall of said second housing such that said annular suction chamber surrounds said central discharge chamber;

a drive shaft rotatably provided in and extended through said crank chamber; and a conversion mechanism provided on said drive shaft within said crank chamber for converting a rotating movement of said drive shaft means into a reciprocating movement of each piston in the corresponding cylinder bore such that a suction stroke and a discharge stroke are alternately executed therein, a fluid being introduced from said suction chamber into said cylinder bore during the suction stroke and, during the compression stroke, the introduced fluid being compressed and discharged from said cylinder bore into said discharge chamber, wherein said cylinder block is provided with a portion extended radially and outwardly from a side thereof, said portion having a damping chamber formed therein, and wherein the discharge chamber has an elongated portion extended radially and outwardly therefrom, said elongated portion being in communication with said damping chamber through a small passage formed in the extended portion of said cylinder block.

2. A single-headed piston type swash-plate compressor as set forth in claim 1, further comprising a valve plate assembly provided between said other end side of said cylinder block and said second housing, said small passage being formed in both the extended portion of said cylinder block and the valve plate assembly.

3. A single-headed piston type swash-plate compressor as set forth in claim 1, wherein the elongated portion of the discharge chamber is disposed along a radially-extended zone.

4. A single-headed piston type swash-plate compressor as set forth in claim 1, wherein the extended portion of said cylinder block has a recess formed therein and closed by a lid member to define said damping chamber therebetween.

* * * * *